US008957831B1

(12) United States Patent
Gregoire et al.

(10) Patent No.: US 8,957,831 B1
(45) Date of Patent: Feb. 17, 2015

(54) ARTIFICIAL MAGNETIC CONDUCTORS

(75) Inventors: Daniel J. Gregoire, Thousand Oaks, CA (US); Carson R. White, Westlake Village, CA (US)

(73) Assignee: The Boeing Company, Chicago, IL (US)

( * ) Notice: Subject to any disclaimer, the term of this patent is extended or adjusted under 35 U.S.C. 154(b) by 1078 days.

(21) Appl. No.: 12/749,672

(22) Filed: Mar. 30, 2010

(51) Int. Cl.
*H01Q 15/02* (2006.01)
*H01Q 1/28* (2006.01)

(52) U.S. Cl.
USPC ..... 343/909; 343/756; 343/705; 343/700 MS

(58) Field of Classification Search
USPC ..... 343/705, 847, 848, 849, 909, 700 MS, 343/756
See application file for complete search history.

(56) References Cited

U.S. PATENT DOCUMENTS

| | | | | |
|---|---|---|---|---|
| 6,262,498 | B1 | 7/2001 | Leiber | |
| 6,323,826 | B1 | 11/2001 | Sievenpiper | |
| 6,426,722 | B1 | 7/2002 | Sievenpiper | |
| 6,433,756 | B1 | 8/2002 | Sievenpiper | |
| 6,483,480 | B1 | 11/2002 | Sievenpiper | |
| 6,483,481 | B1 | 11/2002 | Sievenpiper | |
| 6,496,155 | B1 | 12/2002 | Sievenpiper | |
| 6,538,621 | B1 | 3/2003 | Sievenpiper | |
| 6,774,866 | B2 * | 8/2004 | McKinzie et al. | 343/909 |
| 7,023,386 | B2 * | 4/2006 | Habib et al. | 343/700 MS |
| 7,420,524 | B2 * | 9/2008 | Werner et al. | 343/909 |
| 7,612,718 | B2 | 11/2009 | Sievenpiper | |
| 7,639,207 | B2 | 12/2009 | Sievenpiper | |
| 8,134,521 | B2 * | 3/2012 | Herz et al. | 343/912 |
| 8,212,739 | B2 * | 7/2012 | Sievenpiper | 343/909 |
| 2009/0109121 | A1 | 4/2009 | Herz et al. | |

FOREIGN PATENT DOCUMENTS

JP 2003298464 A * 10/2003

OTHER PUBLICATIONS

Galina, High-Impedance Surface with Aperiodically-Ordered Textures, Electromagnetics in Advanced Applications, 2007. ICEAA 2007, pp. 49-52.
Akhoondzadeh-Asl, et al., Wideband Dipoles on Electromagnetic Bandgap Ground Planes, IEEE Transactions on Antennas and Propagation, vol. 55, No. 9, Sep. 2007.
Kim, et al., Compact Artificial Magnetic Conductor Designs Using Planar Square Spiral Geometries, Progress in Electromagnetics Research, PIER 77, 43-54, 2007.
Golla, Keven, Broadband Application of High Impedance Ground Planes, Department of the Air Force, Air Force Institute of Technology.
Sievenpiper, Dan, et al., A Tunable Impedance Surface Performing as a Reconfigurable Beam Steering Reflector, IEEE Transactions on Antennas and Propagation, vol. 50, No. 3, Mar. 2002.

(Continued)

*Primary Examiner* — Hoang V Nguyen
(74) *Attorney, Agent, or Firm* — Toler Law Group, PC

(57) ABSTRACT

In one embodiment an artificial magnetic conductor assembly to reflect an electromagnetic signal with a phase shift that measures between −90 degrees and +90 degrees at a target frequency comprises a first ground plane, a plurality of metallic elements disposed at a first distance from the first ground plane, a plurality of capacitors coupling adjacent metallic elements of the plurality of metallic elements, and a dielectric substrate disposed between the first ground plane and the array of metallic elements and formed from a material having a relative permittivity that measures between 1 and 20.

20 Claims, 6 Drawing Sheets

(56) References Cited

OTHER PUBLICATIONS

Sievenpiper, Dan, et al., Holographic Artificial Impedance Surfaces for Conformal Antennas, IEEE, 2005.

Sievenpiper, Dan, High Impedance Electromagnetic Surfaces, UCLA Dissertation, 1999.

Romulo Broas, An Application of High Impedance Ground Planes to Phased Array Antennas, IEEE Transactions on Antennas and Propagation, Apr. 2005.

* cited by examiner

ARTIFICIAL MAGNETIC CONDUCTORS

RELATED APPLICATIONS

None

FIELD OF THE DISCLOSURE

The subject matter described herein relates to artificial magnetic conductors. More particularly, the disclosure relates to artificial magnetic conductors which are tunable to one or desired resonance frequencies.

BACKGROUND

Artificial magnetic conductors (AMCs) are surface treatments that control the phase of reflection of an incident electromagnetic wave. AMCs are characterized by a resonant frequency, $f_{res}$, at which where the phase of reflection is 0 degrees, and by their ±90 degrees bandwidth in which the reflected phase lies between −90 and +90 degrees. In general, AMCs may be constructed by applying a capacitive metallic grid on top of a dielectric substrate with a ground plane. The size of the grid and its period scales with the resonant frequency. The bandwidth scales with substrate thickness. Thus, as the target resonant frequency decreases, the grid period and the substrate thickness increases proportionately in order to maintain the same bandwidth.

To implement AMCs with sufficient and practical bandwidth at lower frequencies, such as in the VHF band (30-300 MHz) and in the lower end of the UHF band (300 MHz-3 GHz), the size of the structure must be scaled proportionally. By way of example, a 10 GHz AMC may be fabricated using relatively thin (e.g., 0.025-0.050" thick) substrates of standard electronic circuit board material. By contrast, a VHF AMC requires substrate thickness between 0.500 to 1.00 inches, or even greater. Therefore, using standard electronic substrates is prohibitive for practical application because of availability, cost and weight. For example, a 1.00 inch thick AMC using Rogers Corp. 3010 substrate material will weigh more than 7.08 kg per square foot. Also, standard circuit board substrates have permittivity typically 2.0 or more. The higher the substrate permittivity, the lower the bandwidth of the AMC because the capacitance between the grid and the ground planes is proportional to the substrate permittivity.

Therefore, apparatus and methods to form AMCs capable of implementing relatively low-frequency (e.g., VHF and UHF band) communication may find utility.

SUMMARY

In various aspects, artificial magnetic conductor assemblies are disclosed. In one embodiment an artificial magnetic conductor assembly to reflect an electromagnetic signal with a phase shift that measures between −90 degrees and +90 degrees at a target frequency comprises a first ground plane, a plurality of metallic elements disposed at a first distance from the first ground plane, a plurality of capacitors coupling adjacent metallic elements of the plurality of metallic elements, and a dielectric substrate disposed between the first ground plane and the array of metallic elements and formed from a material having a relative permittivity that measures between 1 and 20.

In another embodiment, an artificial magnetic conductor assembly to reflect an electromagnetic signal with a phase shift that measures between −90 degrees and +90 degrees at a target frequency comprises a first ground plane and a second ground plane disposed adjacent the first ground plane, a plurality of metallic elements disposed at a first distance from the first ground plane, and a plurality of variable capacitors electrically coupled to the first ground plane and the second ground plane.

In yet another embodiment, an aircraft, comprises a fuselage, an antenna assembly, and an artificial magnetic conductor assembly to reflect an electromagnetic signal with a phase shift that measures between −90 degrees and +90 degrees at a target frequency. The artificial magnetic conductor assembly comprises a first ground plane and a second ground plane disposed adjacent the first ground plane, a plurality of metallic elements disposed at a first distance from the first ground plane a first plurality of variable capacitors electrically coupled to the first ground plane, and a second plurality of variable capacitors electrically coupled to the second ground plane, wherein the first ground plane comprises a plurality of holes through which vias from the second ground plane pass, and at least one shunt capacitor coupled to the first ground plane and to at least one of the plurality of vias.

The features, functions and advantages discussed herein can be achieved independently in various embodiments described herein or may be combined in yet other embodiments, further details of which can be seen with reference to the following description and drawings.

BRIEF DESCRIPTION OF THE DRAWINGS

The detailed description is described with reference to the accompanying figures.

DETAILED DESCRIPTION

Figure 1:
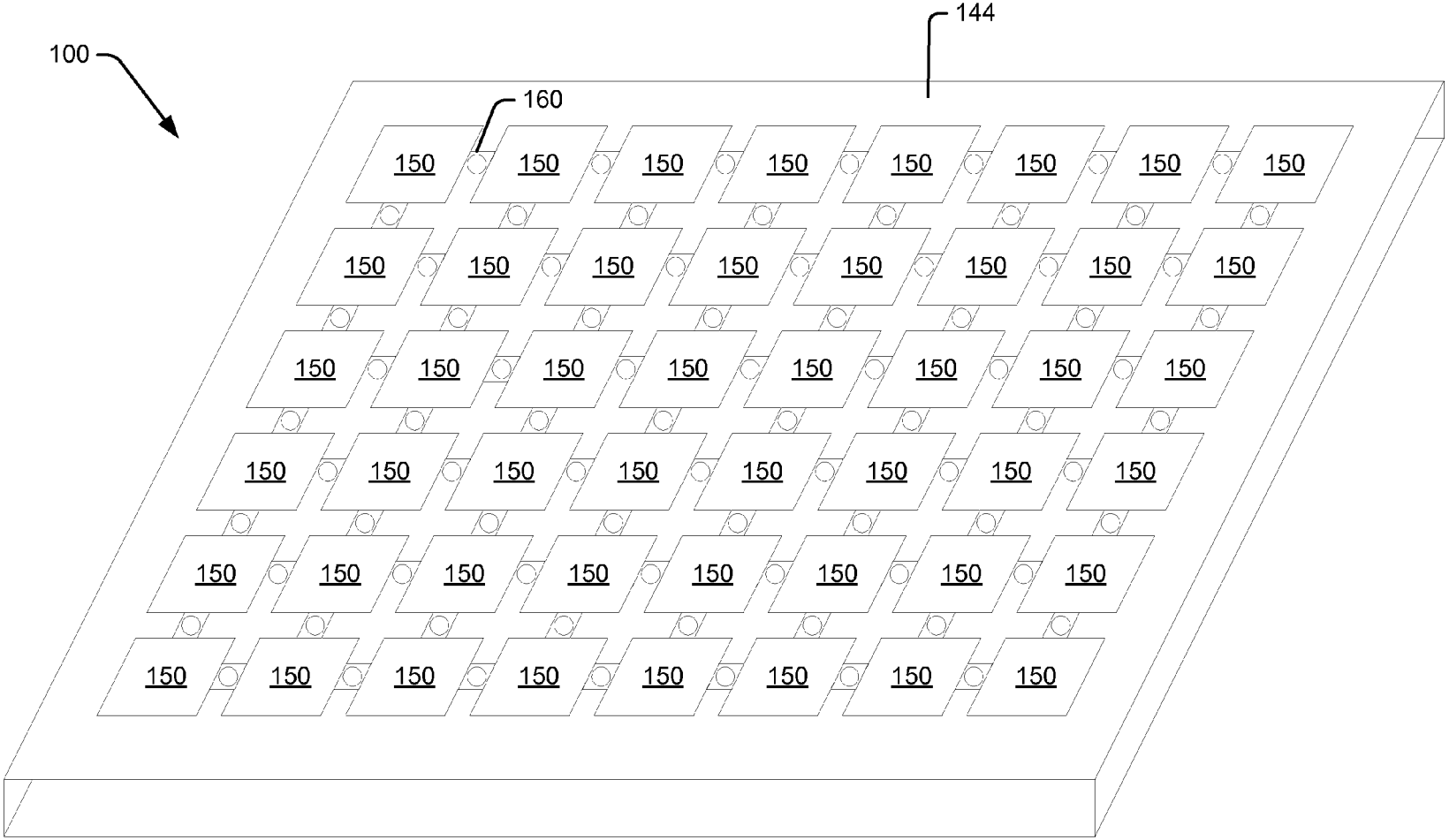
FIG. 1 is an illustration of a perspective view of one embodiment of an artificial magnetic conductor assembly.

Described herein are exemplary artificial magnetic conductor (AMC) assemblies and aircraft comprising such assemblies. Such artificial magnetic conductor assemblies may be useful, e.g., in providing low-profile antenna structures which may be mounted on a vehicle such as, e.g., an aircraft or the like. Further described herein are methods to make an AMC that operates in the UHF and VHF frequency range without having to use costly and heavy substrates. Also described are methods to make a tunable AMC with multiple ground planes for biasing tunable capacitors without the detriment caused by RF leakage from the bias lines between the ground planes.

In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

Referring to FIGS. 1-4 in one embodiment an artificial magnetic conductor assembly 100 to reflect an electromagnetic signal is provided. In one embodiment, the assembly 100 comprises a first ground plane 110, a plurality of metallic elements 150 disposed at a first distance from the first ground plane, a plurality of capacitors 160 coupling adjacent metallic elements 150 of the plurality of metallic elements 150, and a dielectric substrate 142 disposed between the first ground plane and the array of metallic elements and formed from a material having a relative permittivity that measures between 1 and 20.

Figure 4:
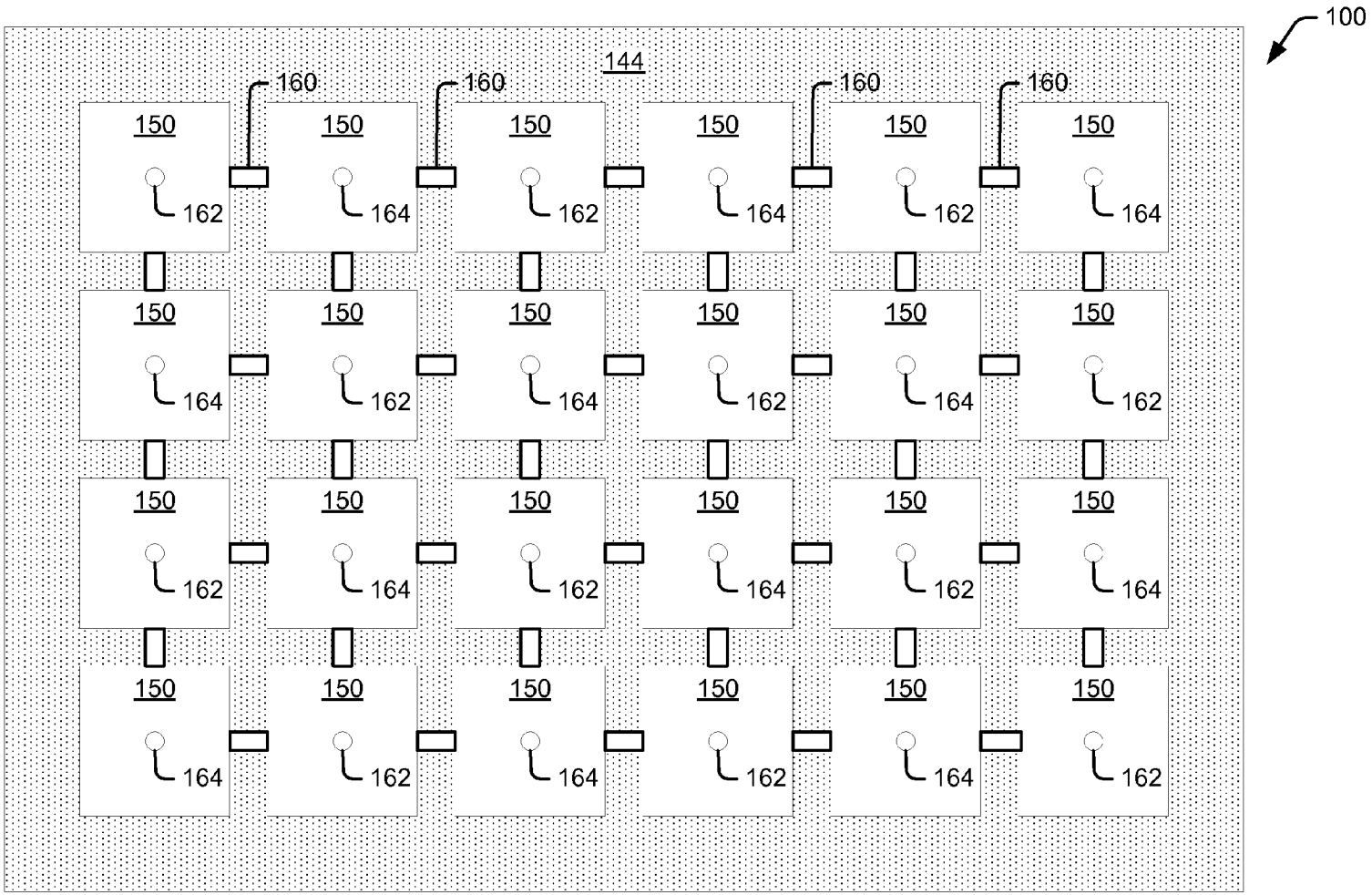
FIG. 4 is an illustration of a plan view of one embodiment of an artificial magnetic conductor assembly.

As illustrated in FIGS. 1 and 4, the metallic elements 150 may be embodied as substantially square metallic elements 150 arranged in a matrix and disposed on a substrate 144 in a plane substantially parallel to the first ground plane. In some embodiments the plurality of metallic elements 150 measure between 0.1 inches and 100 inches in width and 0.1 inches and 100 in length. Adjacent metallic elements 150 are separated by a distance that measures between 0.001 inches and 10.000 inches. One skilled in the art will recognize that the specific shape of the metallic elements 150 and the specific separation between adjacent elements 150 are not critical and may be adjusted to accommodate different resonance frequencies and bandwidth requirements. Alternate shapes and separation distances for metallic elements 150 are described in U.S. Pat. No. 6,538,621 to Sievenpiper, et al., the disclosure of which is incorporated herein by reference in its entirety.

Adjacent metallic elements 150 may be capacitively coupled by capacitors 160. In the embodiment depicted in FIGS. 1-4 the capacitors 160 couple adjacent metallic elements 150 in both directions, such that the assembly 100 may be used for incident radiation of any polarization. In alternate embodiments the capacitors 160 may couple adjacent metallic elements 150 in only a single direction, such that the assembly 100 may be used for incident radiation polarized parallel to the plane comprised by adjacent metallic elements connected with the capacitors. The grid is loaded with load capacitors 160 that are electrically connected between each metallic element 150 and its nearest neighbors in order to add capacitance to the grid. In some embodiment the capacitors 160 may be implemented as fixed capacitors, i.e., capacitors which have a substantially constant capacitance. In other embodiments capacitors 160 may be implemented as variable capacitors, the capacitance of which may be varied to adjust the resonant frequency of the assembly 100 to a desired value.

Capacitors 160 can take a variety of forms, including microelectromechanical capacitors, plunger-type actuators, thermally activated bimetallic plates, or any other device for effectively varying the capacitance between a pair of capacitor plates. In some embodiments variable capacitors 160 may be implemented as junction tuning varactor diodes, which are a type of solid state diode which has a variable capacitance that is a function of the voltage impressed on its terminals By varying the capacitance applied to the metallic elements at different locations on the matrix of metallic elements 150 a location-dependent reflection phase results. Thus, a tunable, high-impedance reflective surface is provided.

In some embodiments, the assembly 100 may be tuned to 300 MHz by using capacitors 160 having a capacitance between 1 and 100 picoFarads (pF). In some embodiments, the capacitors 160 may be implemented as variable capacitors (e.g., varactors) that have a capacitance which ranges from 1 to 100 pF in order to tune the assembly 100 to a range from 50 to 1000 MHz.

Figure 2:
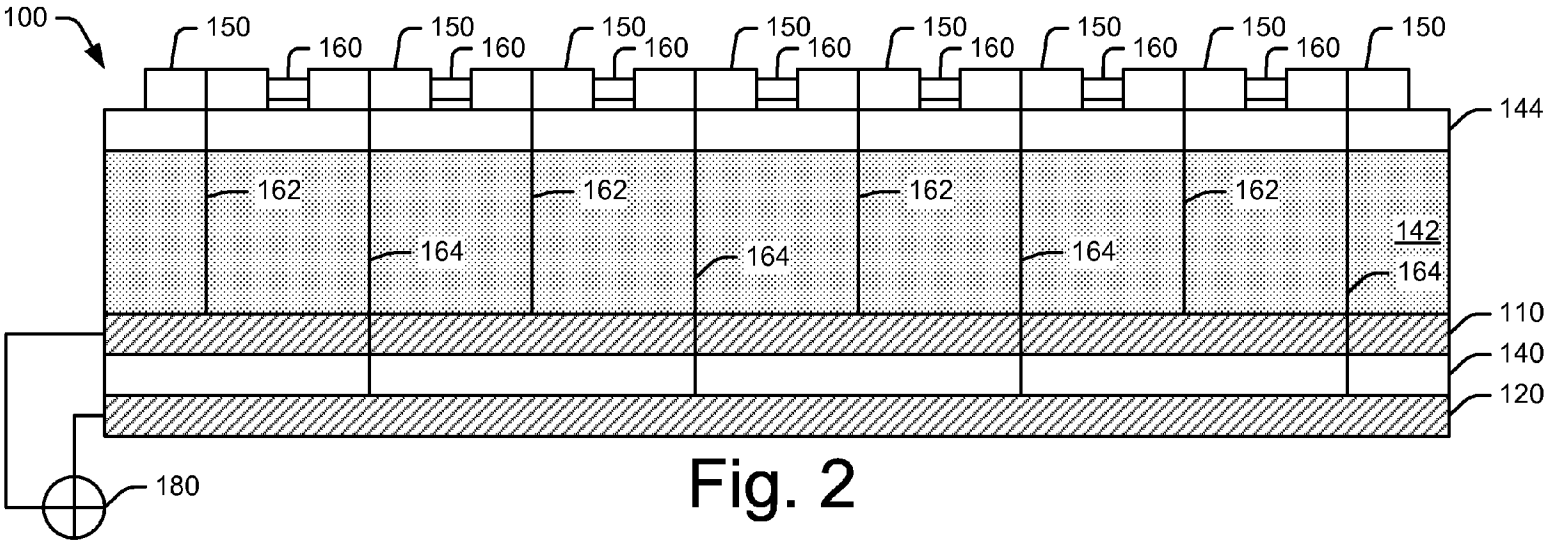
FIG. 2 is an illustration of a sectional view of one embodiment of an artificial magnetic conductor assembly.

Having described the metallic layer of the assembly 100, additional details about the structure of the assembly 100 will be described with reference to FIG. 2. Referring briefly to FIG. 2, in some embodiments of the assembly 100, the metallic elements 150 and capacitors 160 are mounted on a substrate 144. The substrate 144 is mounted on a dielectric substrate 142, which is mounted on the first ground plane 110. A second ground plane 120 is disposed adjacent the first ground plane 110, separated by a dielectric layer 140. In some embodiments the substrate 144 may be embodied as a circuit board formed from a suitable dielectric material, e.g., flame retardant 4 (FR4) circuit board material. The dielectric substrate 142 may be formed from a suitable foam material, e.g., a composite such as Rohacell H31 having a thickness that measures between 0.1 inches and 10.0 inches, and which exhibits a relative permittivity that measures between 1 and 20. The dielectric layer 140 may be formed from a suitable dielectric material, e.g., FR4.

In embodiments in which the capacitors 160 comprises variable capacitors, a first plurality of the metallic elements 150 are electrically coupled to the first ground plane 110 by vias 162, and a second plurality of the metallic elements 150 are electrically coupled to the second ground plane 120 by vias 164. In practice, the metallic elements 150 may be coupled to the first ground plane 110 and the second ground plane 120 in an alternating fashion. The first ground plane 110 and the second ground plane 120 are coupled to a voltage controller 180, which applies a bias voltage to the metallic elements 150 via the first ground plane 110 and the metallic elements 150 coupled to the second ground plane 120, thereby generating a voltage differential across the variable capacitors 160. The bias voltage generated by the voltage controller 180 may be adjusted to tune the artificial magnetic conductor assembly 100 to a predetermined resonance frequency.

Figure 3:
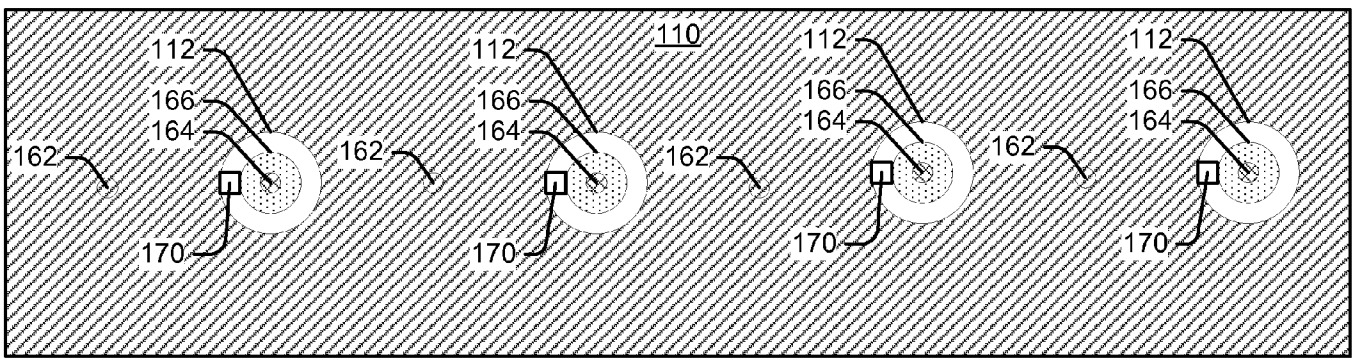
FIG. 3 is an illustration of a plan view of a section of one embodiment of ground plane used in an artificial magnetic conductor assembly.

Referring now to FIG. 3 the first ground plane 110 comprises a plurality of holes 112 through which vias 164 which couple to the second ground plane 120 pass. As illustrated in FIG. 3, the vias 164 have a shunt capacitor 170 that is coupled to the first ground plane 110 and to a bias feedthrough 166 in at least one of the plurality of vias 112. The vias 164 are electrically connected to the bias feedthroughs 166. The shunt capacitors effectively short the first ground plane to the second ground plane through the feedthroughs 166 to reduce RF leakage from the first ground plane 110. The vias 162 are electrically connected to the first ground plane 110.

Thus, having described aspects of the structure of an artificial magnetic conductor assembly 100, attention will now be turned to the operation of the assembly 100. In operation, an artificial magnetic conductor assembly 100 may be coupled to a voltage controller 180 as indicated in FIG. 2. The voltage controller 180 generates a voltage differential across adjacent metallic elements 150 on the surface of the assembly 100. The voltage differential between adjacent elements 150, in turn, tunes the capacitance across the variable capacitors 160. As described above, the capacitors 160 may be implemented as variable capacitors 160, the capacitance of which may be selected to tune the assembly 100 to a desired resonance frequency.

Figure 5:
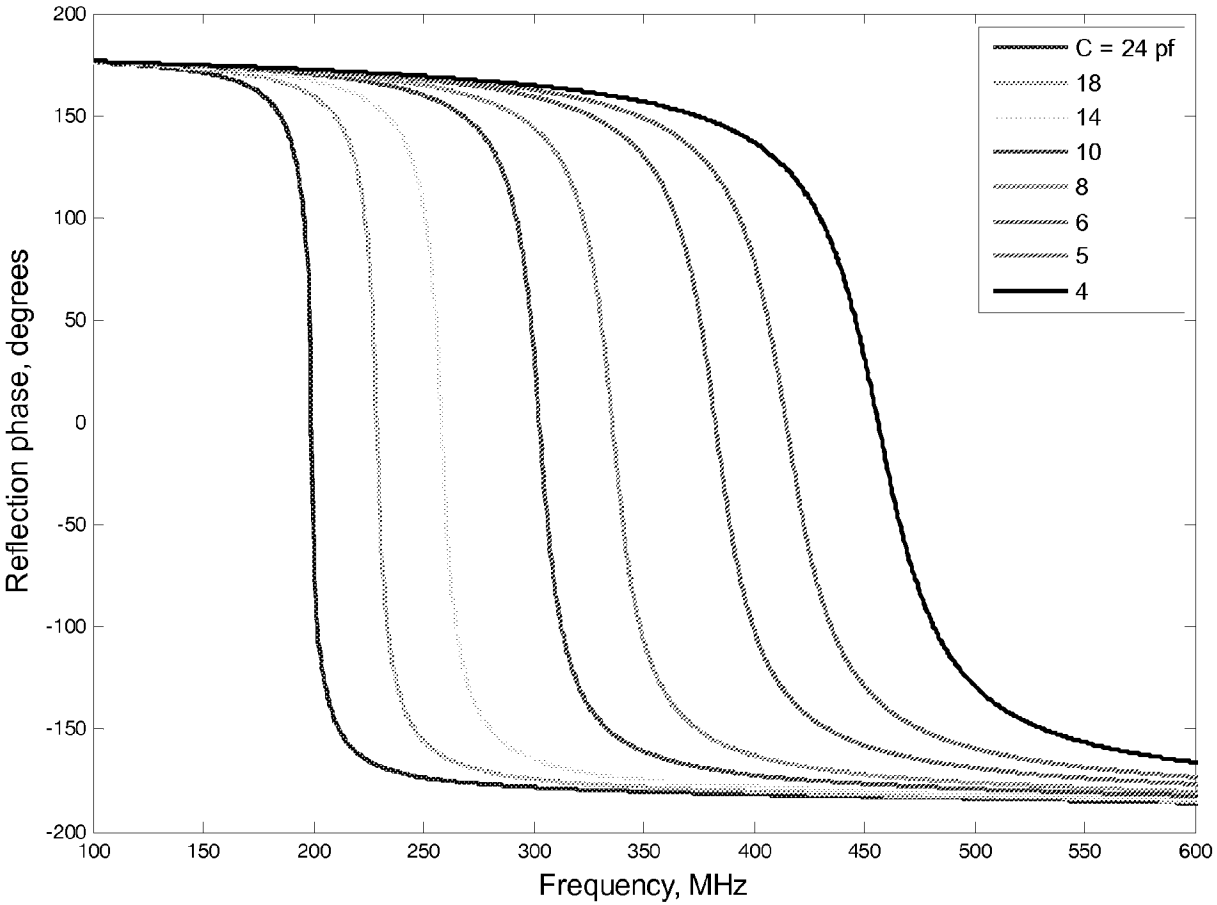
FIG. 5 is a graph which plots the reflection phase and amplitude of an artificial magnetic conductor assembly, according to embodiments.
Figure 6:
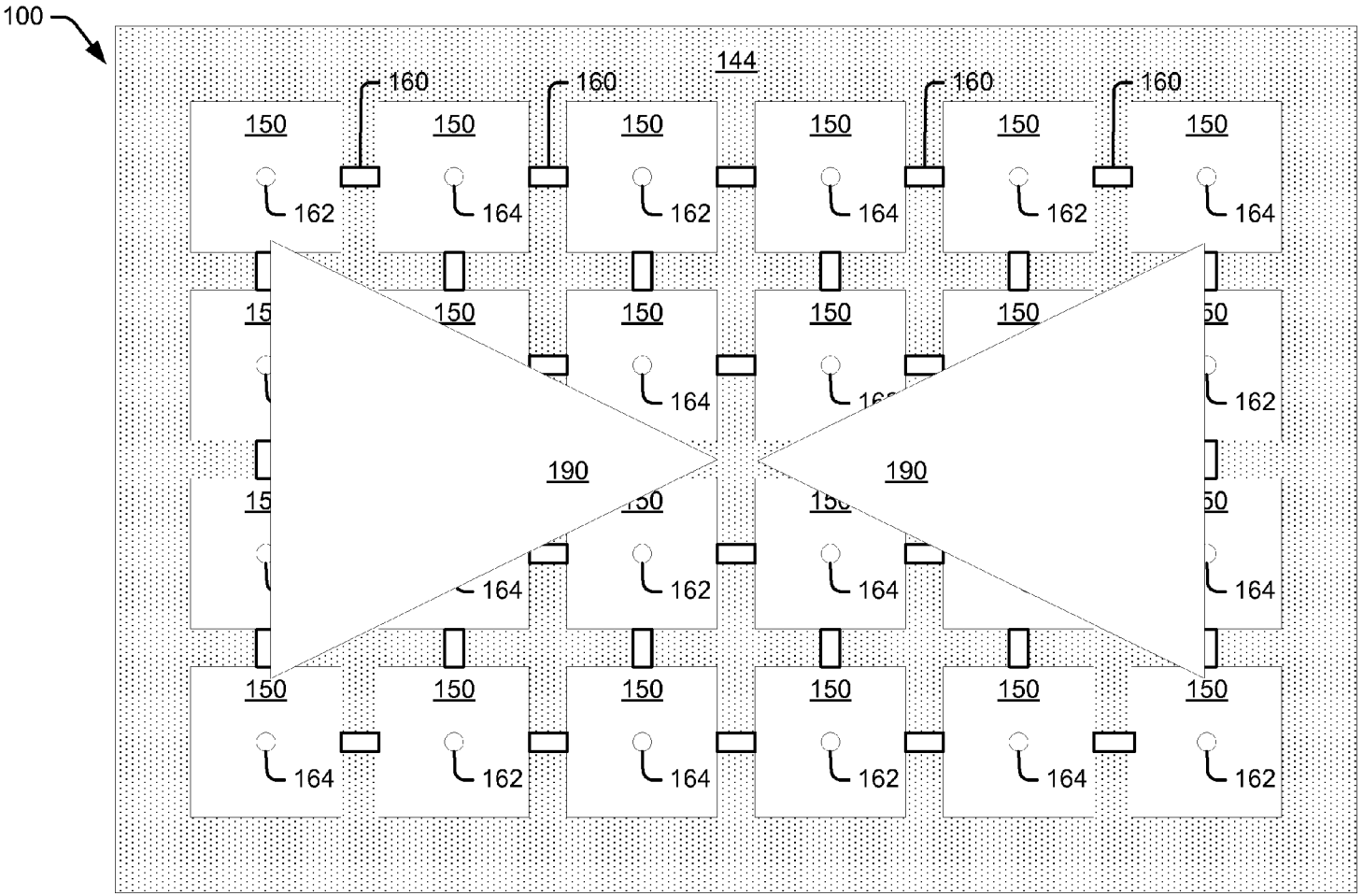
FIG. 6 is a schematic illustration of one embodiment of an artificial magnetic conductor assembly coupled to an antenna assembly.

FIG. 5 is a graph which plots the reflection phase and amplitude of an artificial magnetic conductor assembly 100 as the capacitors 160 are tuned from 4 pF to 24 pF. As illustrated in FIG. 5, in one embodiment adjusting the capacitance from 4 pF to 24 pF allows the metallic frequency of the assembly 100 to be tuned in a frequency range from 200 to 450 MHz FIG. 6 is a schematic illustration of one embodiment of an artificial magnetic conductor assembly coupled to an antenna assembly. Referring to FIG. 6, in some embodiments an antenna assembly 190 may be mounted proximate the array of metallic elements 150 of the artificial magnetic conductor assembly 100. In operation, electromagnetic radiation generated by the antenna assembly 190 may be enhanced by the matrix of metallic elements 150 on the surface of the assembly 100. The AMC allows the antenna to be mounted very close to the surface, as opposed to a metallic surface which will short the antenna and prevent it from radiating except when mounted at least one-quarter (¼) wavelength away from the surface. As described above, by selectively varying the capacitance of the capacitors 160 across the surface of the assembly 100, the assembly 100 may be tuned to enhance antenna operation at a desired frequency.

Figure 7A:
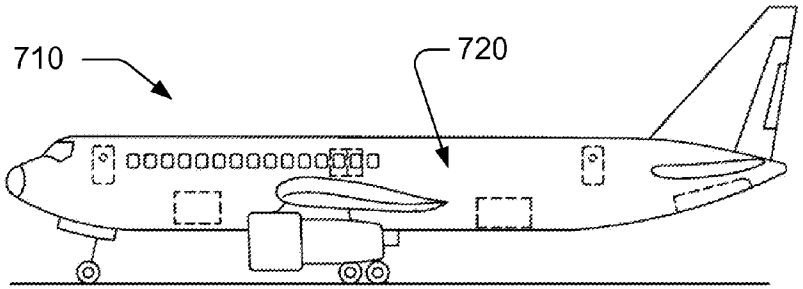
FIGS. 7A, 7B and 7C are schematic illustrations of an aircraft on which an artificial magnetic conductor assembly may be installed, according to embodiments.
Figure 7C:
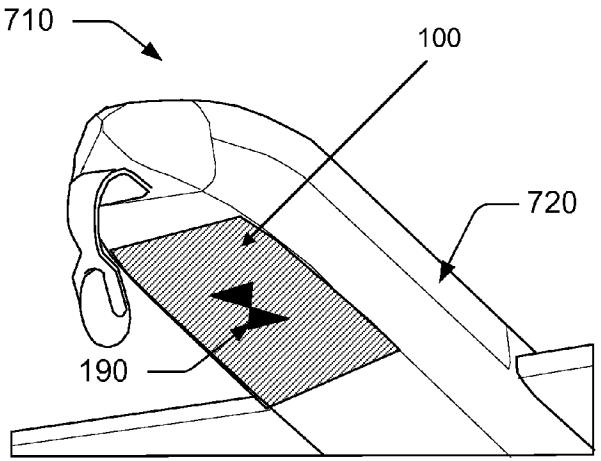
Figure 7B:
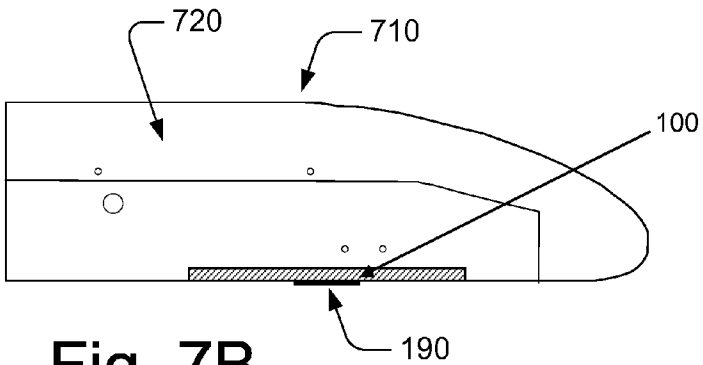

FIGS. 7A-7C are a schematic illustrations of an aircraft 710 on which an artificial magnetic conductor assembly 100 may be installed, according to embodiments. Referring to FIGS. 7A-7C, the aircraft 710 may be a commercial airline, cargo plane, or small passenger plane. In alternate embodiments the aircraft 710 may be a helicopter or a space vehicle. The airplane 710 may comprise a fuselage 720. As depicted in FIGS. 7B-7C, an antenna assembly 190 and an artificial magnetic conductor assembly 100 may be mounted on the fuselage 720 of the aircraft 710. The artificial magnetic conductor assembly 100 allows the antenna 190 to be mounted conformal to a surface without loss of radiation efficiency. Mounting the antenna 190 conformally reduces air drag by eliminating an antenna mast.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. An apparatus comprising:

an artificial magnetic conductor configured to reflect an electromagnetic signal as a reflected signal, the reflected signal having a phase shift of a target frequency relative to the electromagnetic signal, the artificial magnetic conductor comprising:

a first ground plane;

a first dielectric substrate coupled to the first ground plane;

a second ground plane coupled to the first dielectric substrate, wherein the first dielectric substrate is between the first ground plane and the second ground plane;

a second dielectric substrate coupled to the first ground plane;

a plurality of metallic elements coupled to the second dielectric substrate, wherein each metallic element of the plurality of metallic elements is a first distance from the first ground plane; and a plurality of capacitors, each capacitor of the plurality of capacitors coupled to corresponding metallic elements of the plurality of metallic elements, wherein the plurality of capacitors comprise a plurality of variable capacitors.

2. The apparatus of claim 1, wherein the phase shift has a phase shift angle between −90 degrees and 90 degrees.

3. The apparatus of claim 1, wherein the second dielectric substrate comprises a material having a relative permittivity between 1 and 20.

4. The apparatus of claim 1, wherein each metallic element of a first set of metallic elements of the plurality of metallic elements is electrically coupled to the first ground plane by a corresponding first via of a first set of vias, wherein each metallic element of a second set of metallic elements of the plurality of metallic elements is electrically coupled to the second ground plane by a corresponding second via of a second set of vias, wherein the plurality of metallic elements is coupled to the second dielectric substrate, and wherein metallic elements of the first set and metallic elements of the second set are interleaved.

5. The apparatus of claim 4, further comprising a shunt capacitor coupled to the first ground plane and to a first via of the first set of vias.

6. The apparatus of claim 1, wherein the plurality of metallic elements are arranged in a matrix.

7. The apparatus of claim 1, wherein a separation distance between adjacent metallic elements of the matrix is greater than 0.001 inches.

8. The apparatus of claim 1, wherein the first ground plane and the second ground plane are electrically coupled to a voltage controller.

9. The apparatus of claim 8, wherein the voltage controller applies a bias voltage to the first ground plane and to the second ground plane to tune the artificial magnetic conductor to a selected resonance frequency.

10. The apparatus of claim 1, further comprising an antenna mounted proximate the artificial magnetic conductor.

11. An apparatus comprising:

an artificial magnetic conductor configured to reflect an electromagnetic signal as a reflected signal, the reflected signal having a phase shift of a target frequency relative to the electromagnetic signal, the artificial magnetic conductor comprising:

a first ground plane;

a first dielectric substrate coupled to the first ground plane;

a second ground plane coupled to the first dielectric substrate, wherein the first dielectric substrate is between the first ground plane and the second ground plane;

a second dielectric substrate coupled to the first ground plane;

a plurality of metallic elements coupled to the second dielectric substrate, wherein each metallic element of the plurality of metallic elements is a first distance from the first ground plane; and a plurality of variable capacitors, the plurality of variable comprising a first set of variable capacitors and a second set of variable capacitors, wherein each capacitor of the first set of variable capacitors is electrically coupled to the first ground plane, and wherein each capacitor of the second set of variable capacitors is electrically coupled to the second ground plane.

12. The apparatus of claim 11, wherein the first ground plane is between the first dielectric substrate and the second dielectric substrate.

13. The apparatus of claim 11, wherein a separation distance between adjacent metallic elements of the matrix is greater than 0.001 inches.

14. The apparatus of claim 13, further comprising an antenna mounted proximate the artificial magnetic conductor.

15. The apparatus of claim 11, wherein the first ground plane and the second ground plane are electrically coupled to a voltage controller.

16. The apparatus of claim 15, wherein the voltage controller applies a bias voltage to the first ground plane and to the second ground plane to tune the artificial magnetic conductor to a selected resonance frequency.

17. An aircraft, comprising:

a fuselage, an antenna assembly coupled to the fuselage; and an artificial magnetic conductor coupled to the antenna assembly, wherein the artificial magnetic conductor is configured to reflect an electromagnetic signal as a reflected signal, the reflected signal having a phase shift of a target frequency relative to the electromagnetic signal, the artificial magnetic conductor comprising:

a first ground plane;

a first dielectric substrate coupled to the first ground plane;

a second ground plane coupled to the first dielectric substrate, wherein the first dielectric substrate is between the first ground plane and the second ground plane;

a second dielectric substrate coupled to the first ground plane;

a plurality of metallic elements coupled to the second dielectric substrate, wherein each metallic element of the plurality of metallic elements is a first distance from the first ground plane; and a plurality of variable capacitors, the plurality of variable comprising a first set of variable capacitors and a second set of variable capacitors, wherein each capacitor of the first set of variable capacitors is electrically coupled to the first ground plane, and wherein each capacitor of the second set of variable capacitors is electrically coupled to the second ground plane.

18. The aircraft of claim 17, wherein the first ground plane and the second ground plane are electrically coupled to a voltage controller.

19. The aircraft of claim 18, wherein the voltage controller applies a bias voltage to the first ground plane and to the second ground plane to tune the artificial magnetic conductor to a predetermined resonance frequency.

20. The aircraft of claim 17, wherein second dielectric substrate is between the first ground plane and the plurality of metallic elements.

* * * * *